US006729000B1

(12) United States Patent
Liu

(10) Patent No.: US 6,729,000 B1
(45) Date of Patent: May 4, 2004

(54) LACE TIGHTENING ASSEMBLY

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 10/364,369

(22) Filed: Feb. 12, 2003

(51) Int. Cl.[7] ..... A43C 7/04; A43C 1/00; A43C 7/00

(52) U.S. Cl. ..... 24/713.2; 24/712.6; 24/713.6; 24/712.2; 24/132 WL; 24/134 R; 36/50.1

(58) Field of Search ..... 24/712.1, 712.2, 24/712.4, 712.5, 712.6, 712.9, 713.2, 713.6, 713.7, 132 AA, 132 WL, 132 R, 133, 134 R, 134 KB, 134 L; 36/50.1

(56) References Cited

U.S. PATENT DOCUMENTS 52,951 A * 3/1866 Borchardt ..... 24/712.6
340,557 A * 4/1886 Comins ..... 24/712.6
478,122 A * 7/1892 Murphey ..... 24/712.6
536,740 A * 4/1895 Stevens ..... 24/712.6
583,646 A * 6/1897 George ..... 24/712.6
5,548,873 A * 8/1996 Macias ..... 24/134 R

* cited by examiner

*Primary Examiner*—Robert J. Sandy
(74) *Attorney, Agent, or Firm*—Foley & Lardner, LLP

(57) ABSTRACT

A lace tightening assembly is adapted for use with a shoe body having eyelet tabs, and includes a mounting seat mounted on one of the eyelet tabs, a tightening member mounted pivotally in the mounting seat, and an operating member for operating the tightening member to pivot between a shoe lace tightening position and a shoe lace loosening position.

7 Claims, 9 Drawing Sheets

LACE TIGHTENING ASSEMBLY

BACKGROUND OF THE INVENTION

1. Field of the Invention

The invention relates to a lace tightening assembly, more particularly to a lace tightening assembly mounted on eyelet tabs of a shoe.

2. Description of the Related Art

Referring to FIGS. 1, 2 and 3, a conventional lace tightening assembly 1' is mounted on a shoe body 2 for tightening and loosening a shoe lace 3. The conventional lace tightening assembly 1' includes a mounting seat 4 having top and base walls spaced apart from each other, an upright pivot axle 5 extending between the top and base walls of the mounting seat 4, and a tightening member 7 mounted pivotally on the pivot axle 5 and biased by a resilient member 6 from a lace loosening position to a lace tightening position. The mounting seat 4 has a lace guiding surface 401 and a stop unit 402 opposite to the lace guiding surface 401. The lace guiding surface 401 of the mounting seat 4 cooperates with the tightening member 7 to define a shoe lace passage for passage of a shoe lace segment therethrough. The tightening member 7 includes a pivot portion 701 mounted pivotally on the pivot axle 5, and an operating portion 702 extending from the pivot portion 701. The pivot portion 701 of the tightening member 7 is provided with a clamping surface 703 and a smooth surface 704. The clamping surface 703 has a plurality of clamping teeth 705. As best shown in FIG. 2, when the tightening member 7 is at the lace tightening position, a segment of the shoe lace 3 is clamped between the clamping surface 703 of the pivot portion 701 of the tightening member 7 and the lace guiding surface 401 of the mounting seat 4. As best shown in FIG. 3, when the tightening member 7 is at the lace loosening position, the clamping surface 703 is moved away from the lace guiding surface 401. The operating portion 702 of the tightening member 7 moves past the stop unit 402 to retain the tightening member 7 at the lace loosening position. At this time, the smooth surface 704 of the pivot portion 701 permits the segment of the shoe lace 3 to slip through the lace passage to loosen the shoe lace 3.

Although the conventional lace tightening assembly 1' can achieve the purpose of tightening and loosening the shoe lace 3, it has the following shortcomings:

1. The operating portion 702 of the tightening member 7 should be moved past the stop unit 402 to retain the tightening member 7 at the lace loosening position before the segment of the shoe lace 3 can be strung through the lace passage. Therefore, the operation of stringing the shoe lace is relatively troublesome.

2. The conventional lace tightening assembly 1' requires installation of the resilient member 6, which results in a relatively complicated structure and inconvenience during assembly.

3. The segment of the shoe lace 3 is liable to be damaged by the clamping teeth 705.

SUMMARY OF THE INVENTION

Therefore, the object of the present invention is to provide a lace tightening assembly which is relatively simple in structure, which is easy to assemble, and which does not result in damage to the shoe lace.

The lace tightening assembly according to this invention is adapted for use with a shoe body that has a front end, a rear end, a shoe opening adjacent to the rear end, a shoe tongue that extends along a reference line from the front end toward the shoe opening, a pair of eyelet tabs disposed on opposite lateral sides of the shoe tongue, and a shoe lace tied to the eyelet tabs. The lace tightening assembly according to this invention includes a mounting seat, a pivot axle, a tightening member, and an operating member.

The mounting seat is adapted to be mounted on one of the eyelet tabs adjacent to the shoe opening. The mounting seat includes a base wall and a top wall vertically spaced apart from the base wall. Each of the base and top walls has proximate and distal edges respectively disposed proximate to and distal from the shoe opening when the mounting seat is mounted on said one of the eyelet tabs. The mounting seat further includes a side wall that interconnects the distal edges of the base and top walls and that cooperates with the base and top walls to form a lace receiving space. The side wall has an inner wall surface that confronts the lace receiving space and that has first and second wall ends opposite to each other and respectively disposed distal from and proximate to the shoe opening when the mounting seat is mounted on said one of the eyelet tabs. The side wall further has a cord hole formed therethrough for access to the lace receiving space.

The pivot axle extends between the base and top walls, and is disposed between the inner wall surface and the reference line when the mounting seat is mounted on the one of the eyelet tabs.

The tightening member is disposed in the lace receiving space, and has a pivot portion mounted pivotally on the pivot axle, a clamping portion extending from the pivot portion, and an actuating portion extending from the pivot portion and distal from the clamping portion. The tightening member cooperates with the inner wall surface of the side wall to confine a lace passage within the lace receiving space. The lace passage is adapted to permit passage of a segment of the shoe lace therethrough, and has a first passage opening defined by the first wall end and the actuating portion, and a second passage opening defined by the second wall end and the clamping portion.

The operating member includes an operating portion disposed outwardly of the mounting seat, and a pull cord connected to the operating portion. The pull cord extends through the cord hole in the side wall, and is connected to the actuating portion of the tightening member.

The tightening member is pivotable inside the lace receiving space between a shoe lace tightening position, in which the actuating portion is urged by the segment of the shoe lace to pivot toward the reference line to cause the clamping portion to move away from the reference line to thereby clamp the segment of the shoe lace at the second passage opening, and a shoe lace loosening position, in which the actuating portion is pulled to pivot away from the reference line upon application of a pulling force on the operating member to cause the clamping portion to move toward the reference line to thereby release the segment of the shoe lace from being clamped at the second passage opening.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 4:
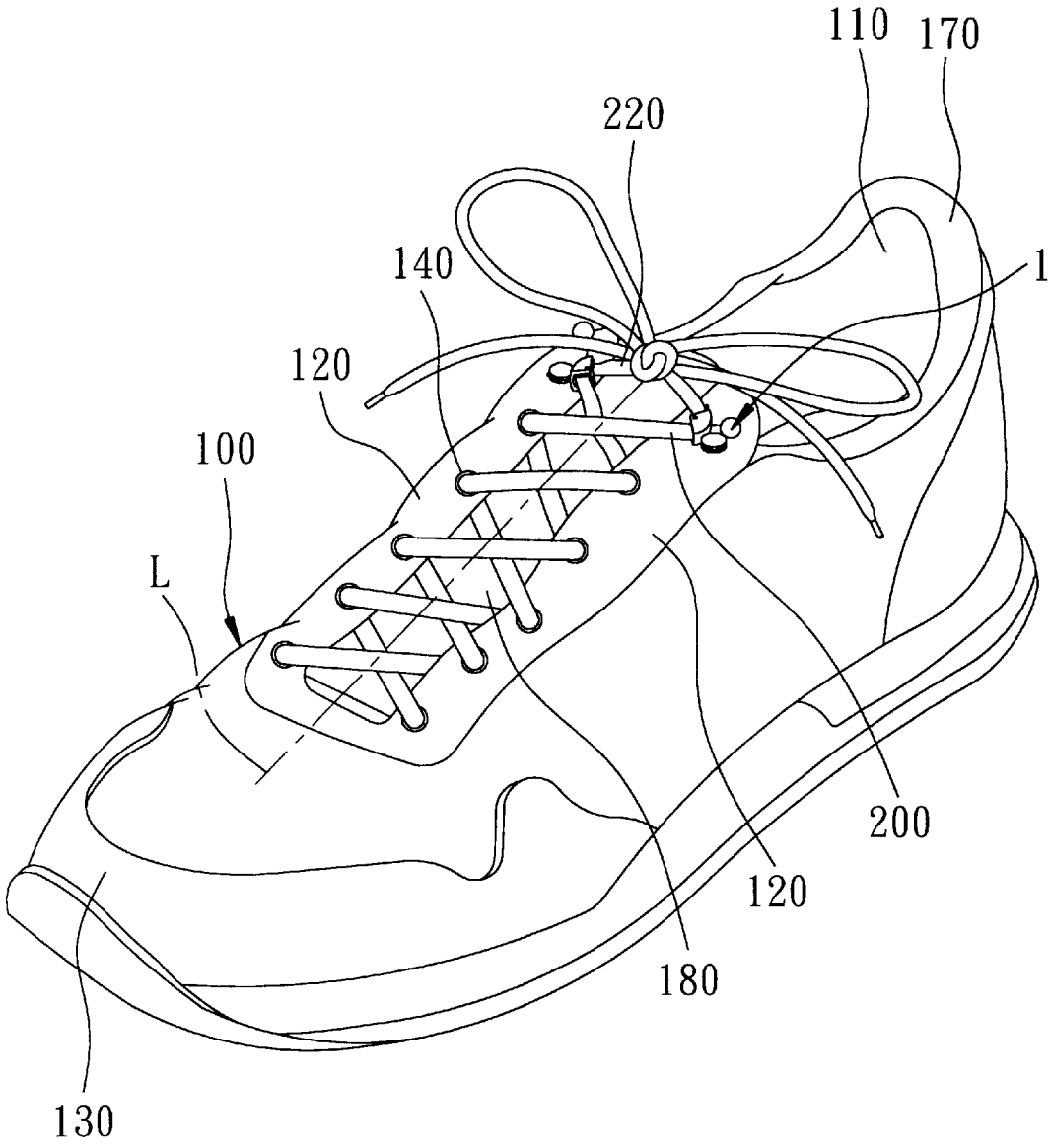
FIG. 4 is a perspective view of the preferred embodiment of the lace tightening assembly according to this invention used with a shoe body.
Figure 5:
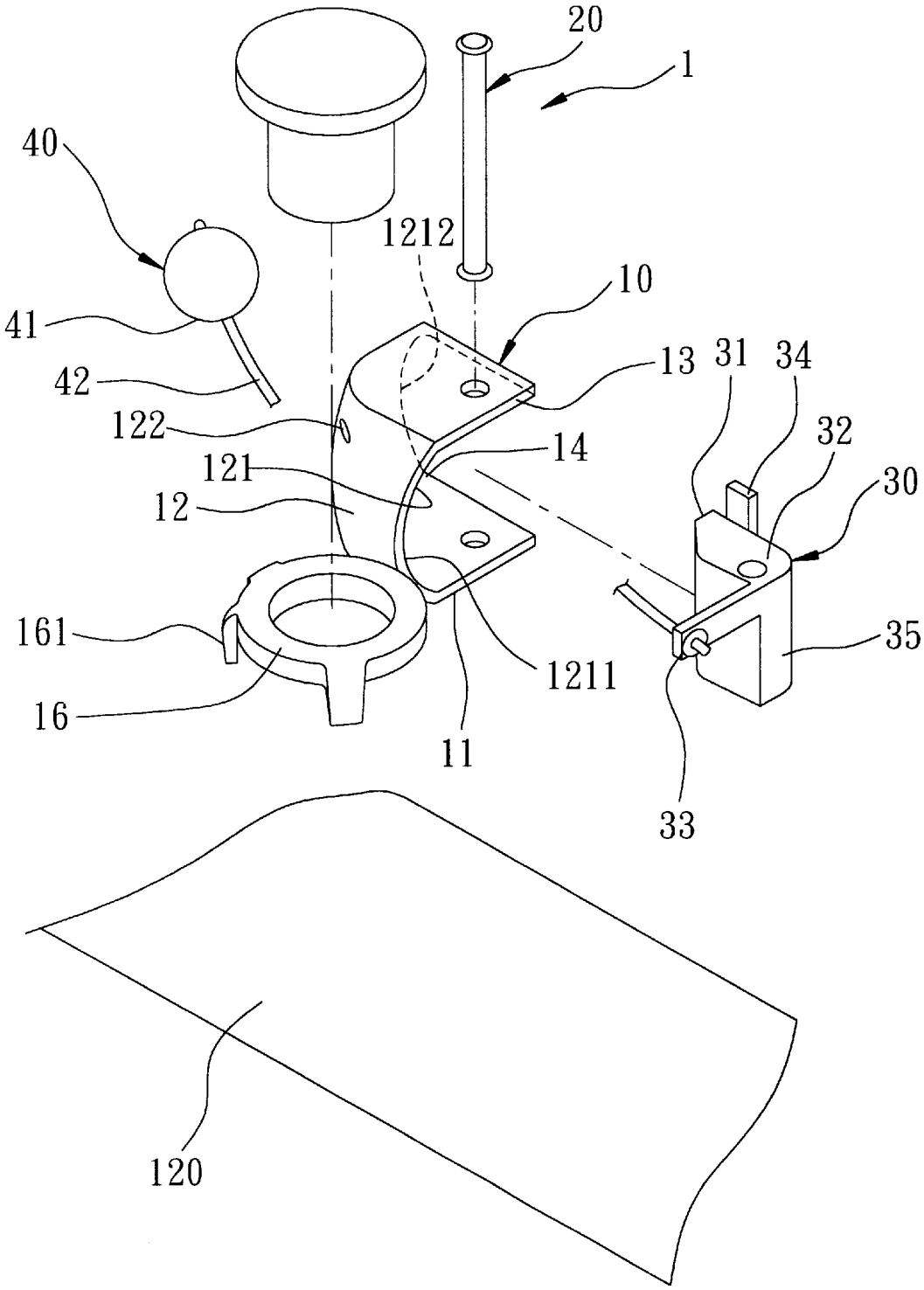
FIG. 5 is an exploded perspective view of the preferred embodiment of the lace tightening assembly according to this invention.
Figure 6:
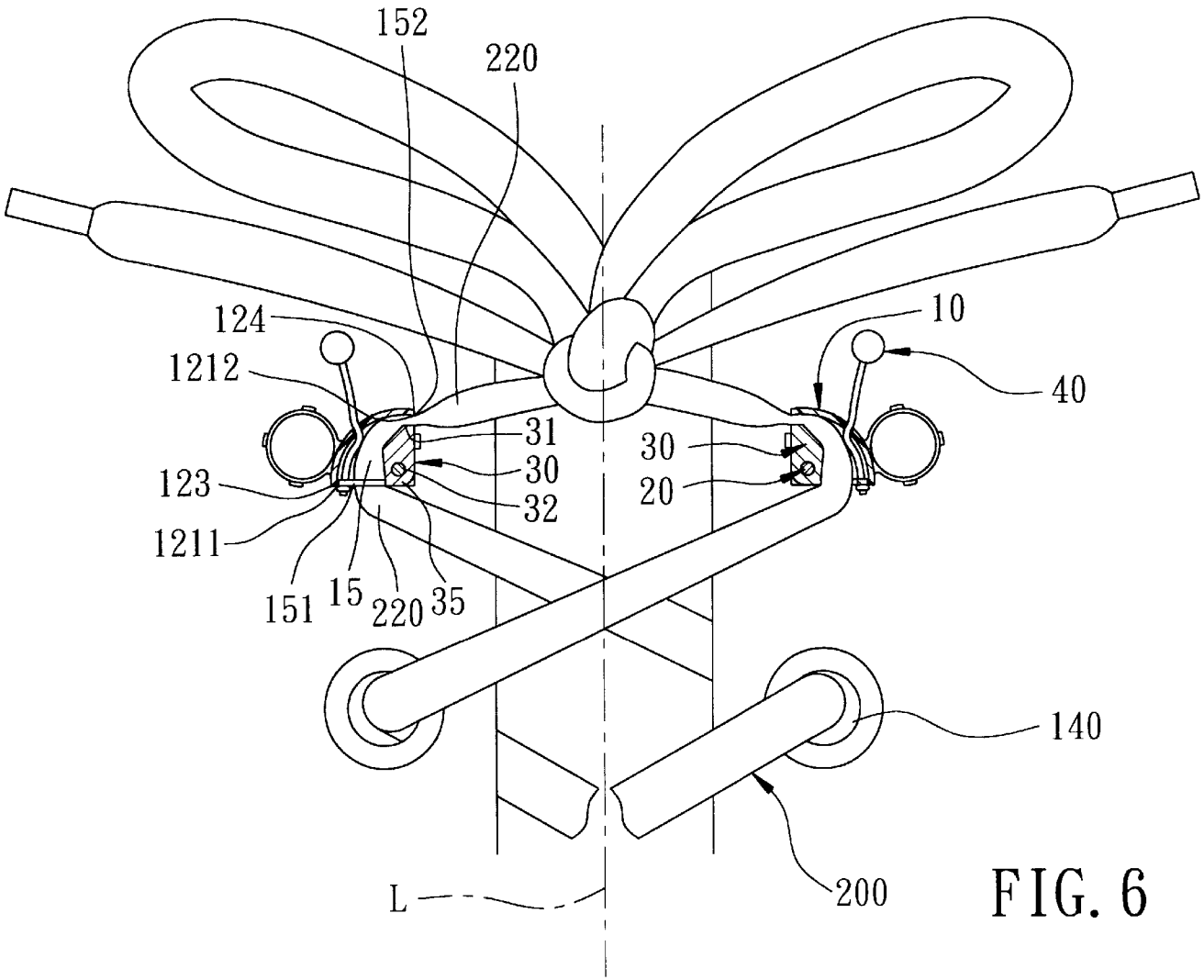
FIGS. 6 and 7 are schematic views of the preferred embodiment in a lace tightening state.

Referring to FIGS. 4, 5 and 6, a pair of the lace tightening assemblies 1 of the preferred embodiment according to this invention is shown to be applied to a shoe body 100 that has a front end 130, a rear end 170, a shoe opening 110 adjacent to the rear end 170, a shoe tongue 180 that extends along a reference line (L) from the front end 130 toward the shoe opening 110, a pair of eyelet tabs 120 disposed on opposite lateral sides of the shoe tongue 180, and a shoe lace 200, which is tied to the eyelet tabs 120 by stringing through eyelets 140 of the eyelet tabs 120 to form a criss-cross pattern on the eyelet tabs 120 and which is tied into a knot proximate to the shoe opening 110. Each lace tightening assembly 1 includes a mounting seat 10, a pivot axle 20, a tightening member 30, and an operating member 40.

The mounting seat 10 is adapted to be mounted on one of the eyelet tabs 120 adjacent to the shoe opening 110. The mounting seat 10 includes a base wall 11 and a top wall 13 vertically spaced apart from the base wall 11. Each of the base and top walls 11, 13 has proximate and distal edges 124, 123 respectively disposed proximate to and distal from the shoe opening 110 when the mounting seat 10 is mounted on the corresponding eyelet tab 120. The mounting seat 10 further includes a side wall 12 that interconnects the distal edges 123 of the base and top walls 11, 13 and that cooperates with the base and top walls 11, 13 to form a lace receiving space 14. The side wall 12 has an inner wall surface 121 that confronts the lace receiving space 14 and that has first and second wall ends 1211, 1212 opposite to each other and respectively disposed distal from and proximate to the shoe opening 110 when the mounting seat 10 is mounted on the corresponding eyelet tab 120. The side wall 12 further has a cord hole 122 formed therethrough for access to the lace receiving space 14.

In the preferred embodiment, the mounting seat 10 further includes a fixing ring 16 connected to the base wall 11 and adapted to be riveted onto the corresponding eyelet tab 120. The fixing ring 16 is formed with anti-slip claws 161 adapted to engage the eyelet tab 120 to resist rotation of the mounting seat 10 on the corresponding eyelet tab 120.

The pivot axle 20 extends between the base and top walls 11, 13, and is disposed between the inner wall surface 121 and the reference line (L) when the mounting seat 10 is mounted on the corresponding eyelet tab 120. Preferably, the pivot axle 20 forms a first radial distance with the first wall end 1211, and further forms a second radial distance shorter than the first radial distance with the second wall end 1212.

The tightening member 30 is disposed in the lace receiving space 14, and has a pivot portion 32 mounted pivotally on the pivot axle 20, a clamping portion 31 extending from the pivot portion 32, and an actuating portion 35 extending from the pivot portion 32 and distal from the clamping portion 31. The tightening member 30 cooperates with the inner wall surface 121 of the side wall 12 to confine a lace passage 15 within the lace receiving space 14. The lace passage 15 is adapted to permit passage of a segment 220 of the shoe lace 200 therethrough, and has a first passage opening 151 defined by the first wall end 1211 and the actuating portion 35, and a second passage opening 152 defined by the second wall end 1212 and the clamping portion 31. The actuating portion 35 is provided with a limit rod 33 that extends toward the inner wall surface 121 of the side wall 12, the purpose of which will be described in the succeeding paragraphs.

The operating member 40 includes an operating portion 41 disposed outwardly of the mounting seat 10, and a pull cord 42 connected to the operating portion 41. The pull cord 42 extends through the cord hole 122 in the side wall 12, and is tied to the actuating portion 35 at the limit rod 33.

Figure 7:
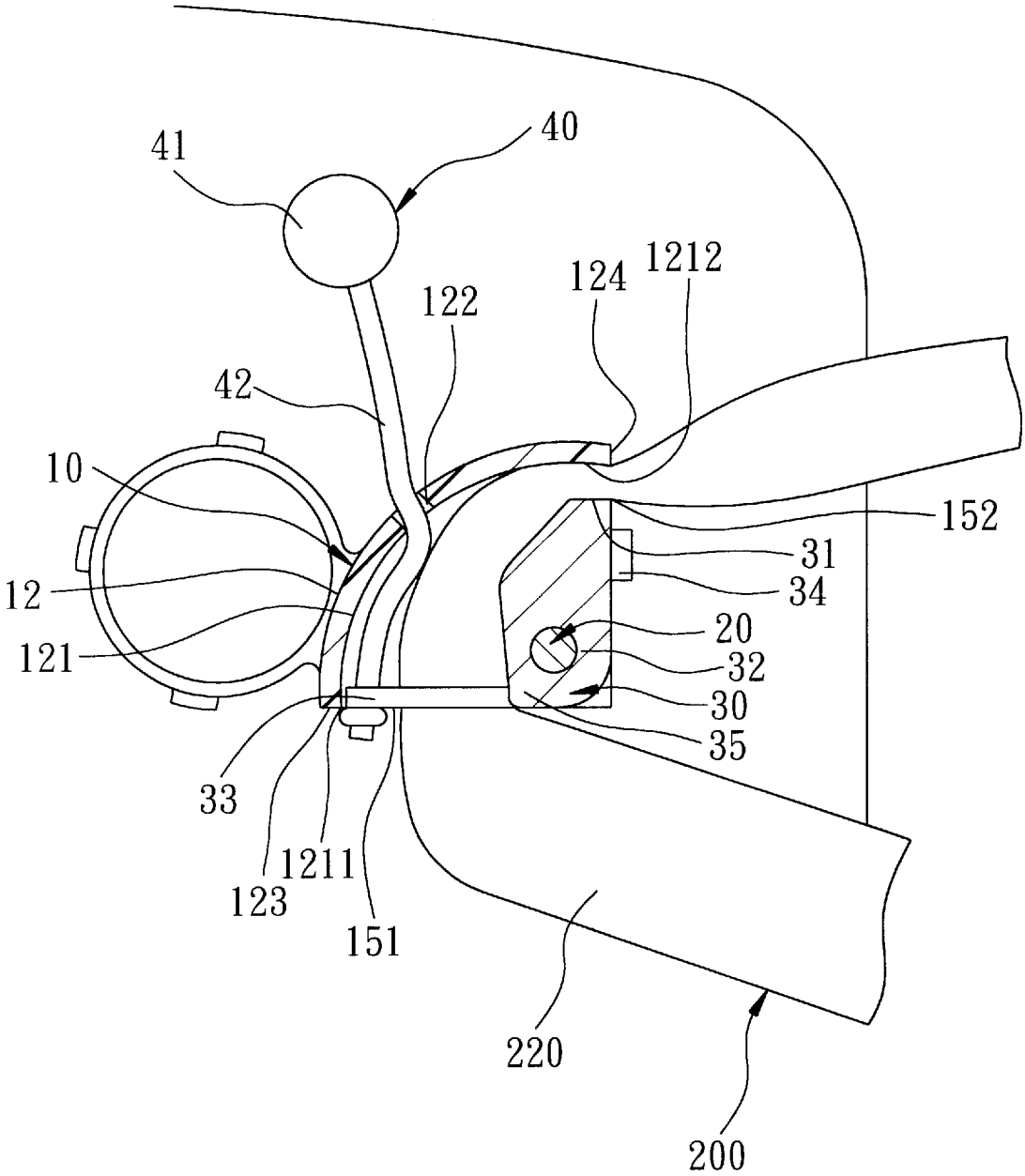
Figure 8:
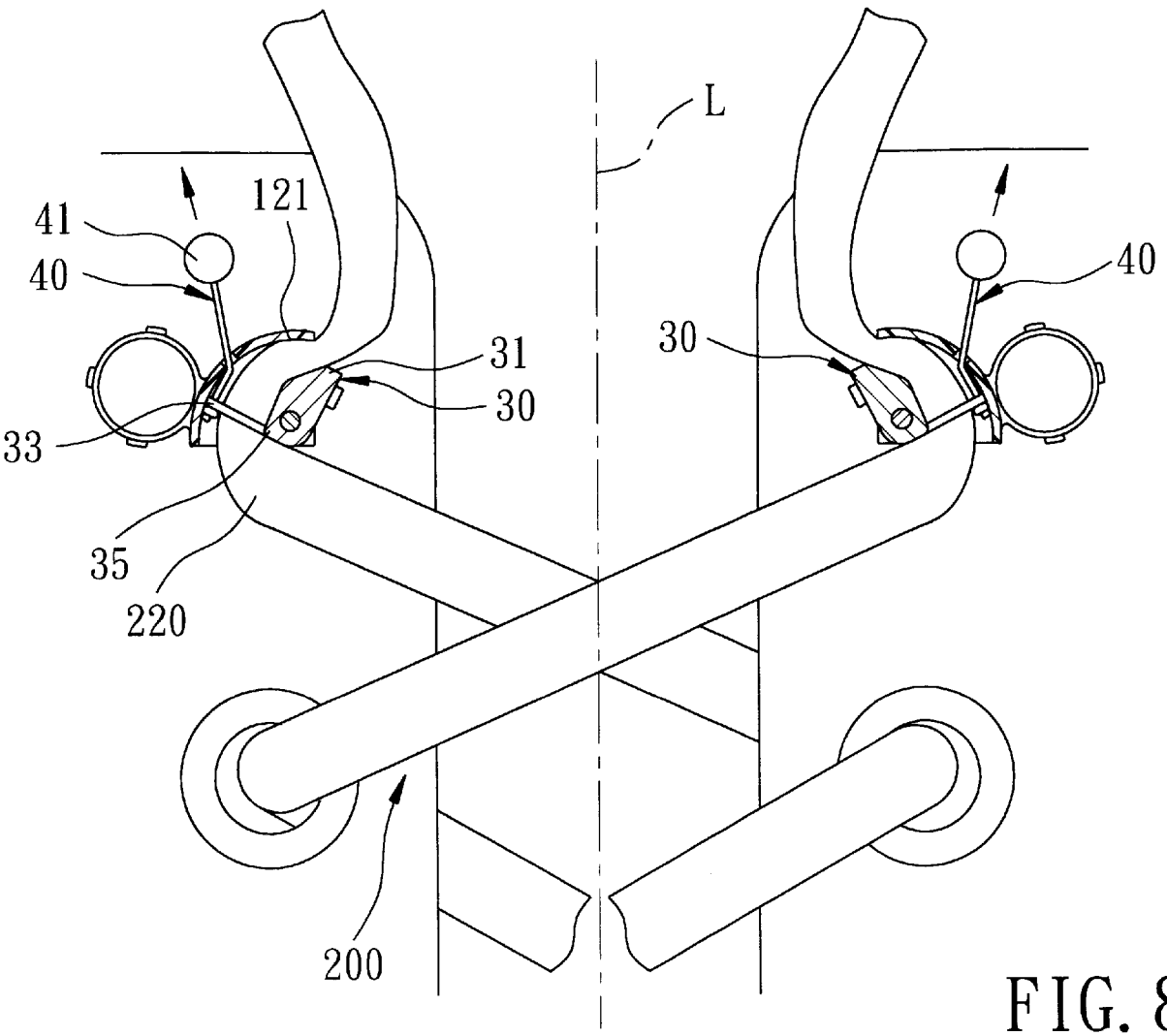
FIG. 8 is a schematic view of the preferred embodiment in a lace loosening state.

Referring to FIGS. 6, 7 and 8, when the segment 220 of the shoe lace 200 is strung through the lace passage 15, the clamping portion 31 is simultaneously urged by the stringing action on the segment 220 toward the reference line (L). Therefore, the segment 220 of the shoe lace 200 can be easily strung through the lace tightening assembly 1 without the need to operate the tightening member 30. Thereafter, the tightening member 30 is pivotable inside the lace receiving space 15 between a shoe lace tightening position illustrated in FIGS. 6 and 7, in which the actuating portion 35 is urged by the segment 220 of the shoe lace 200 to pivot toward the reference line (L) to cause the clamping portion 31 to move away from the reference line (L) to thereby clamp the segment 220 of the shoe lace 200 at the second passage opening 152, and a shoe lace loosening position illustrate in FIG. 8, in which the actuating portion 35 is pulled to pivot away from the reference line (L) upon application of a pulling force on the operating member 40 to cause the clamping portion 31 to move toward the reference line (L) to thereby release the segment 220 of the shoe lace 200 from being clamped at the second passage opening 152. The limit rod 33 of the actuating portion 35 limits extent of pivoting movement of the tightening member 30 from the shoe lace tightening position to the shoe lace loosening position. Furthermore, the clamping portion 31 is formed with a stop unit 34 (see FIG. 5) for engaging the top wall 13 to limit extent of pivoting movement of the tightening member 30 from the shoe lace loosening position to the shoe lace tightening position, as best shown in FIGS. 6 and 7.

Figure 9:
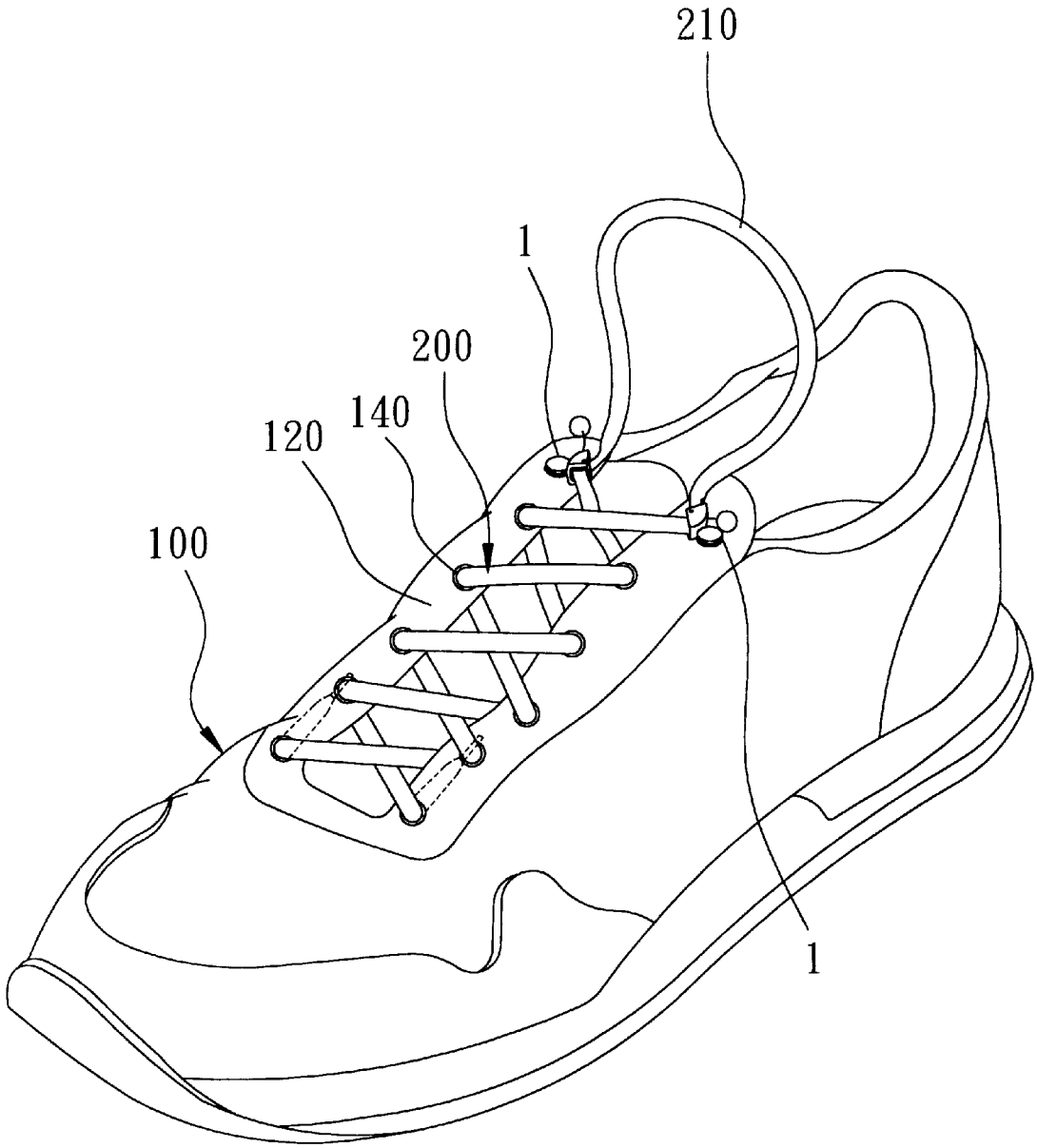
FIG. 9 is a perspective view showing application of the preferred embodiment to another shoe body having a shoe lace strung in a different manner.

Referring to FIG. 9, the lace tightening assembly 1 of the preferred embodiment can be applied to a shoe body 100 having a shoe lace 200 strung in a different manner. The shoe lace 200 is first strung through a pair of the lace tightening assemblies 1 to form a shoe lace loop 210, and is then strung through eyelets 140 to form the criss-cross pattern on the eyelet tabs 120. Finally, the end portions of the shoe lace 200 are clamped under the eyelet tabs 120.

The following are some of the advantages of the lace tightening assembly of this invention:

1. The shoe lace 200 can be easily strung through the lace tightening assembly 1 without the need to operate the tightening member 30.

Figure 1:
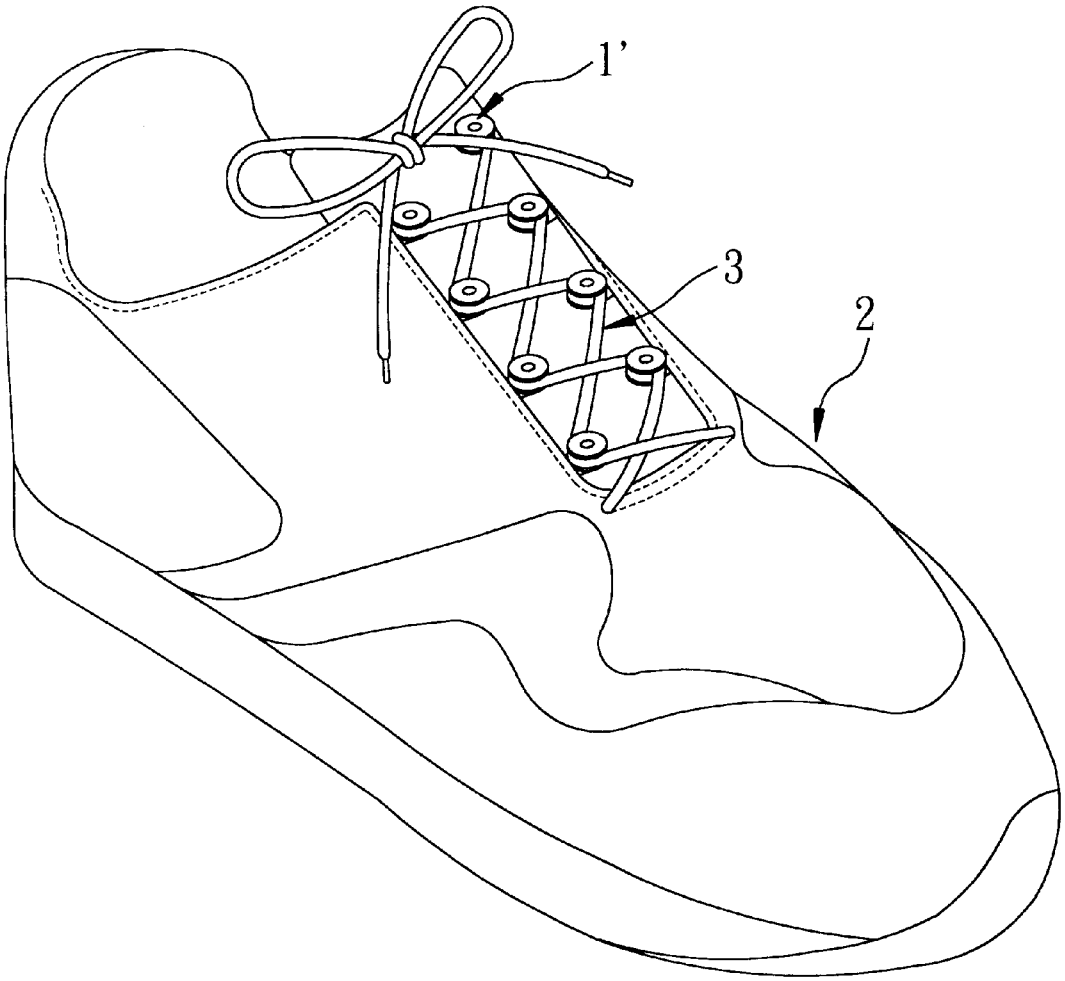
FIG. 1 PRIOR ART
FIG. 1 is a perspective view of a conventional lace tightening assembly used with a shoe body.
Figure 2:
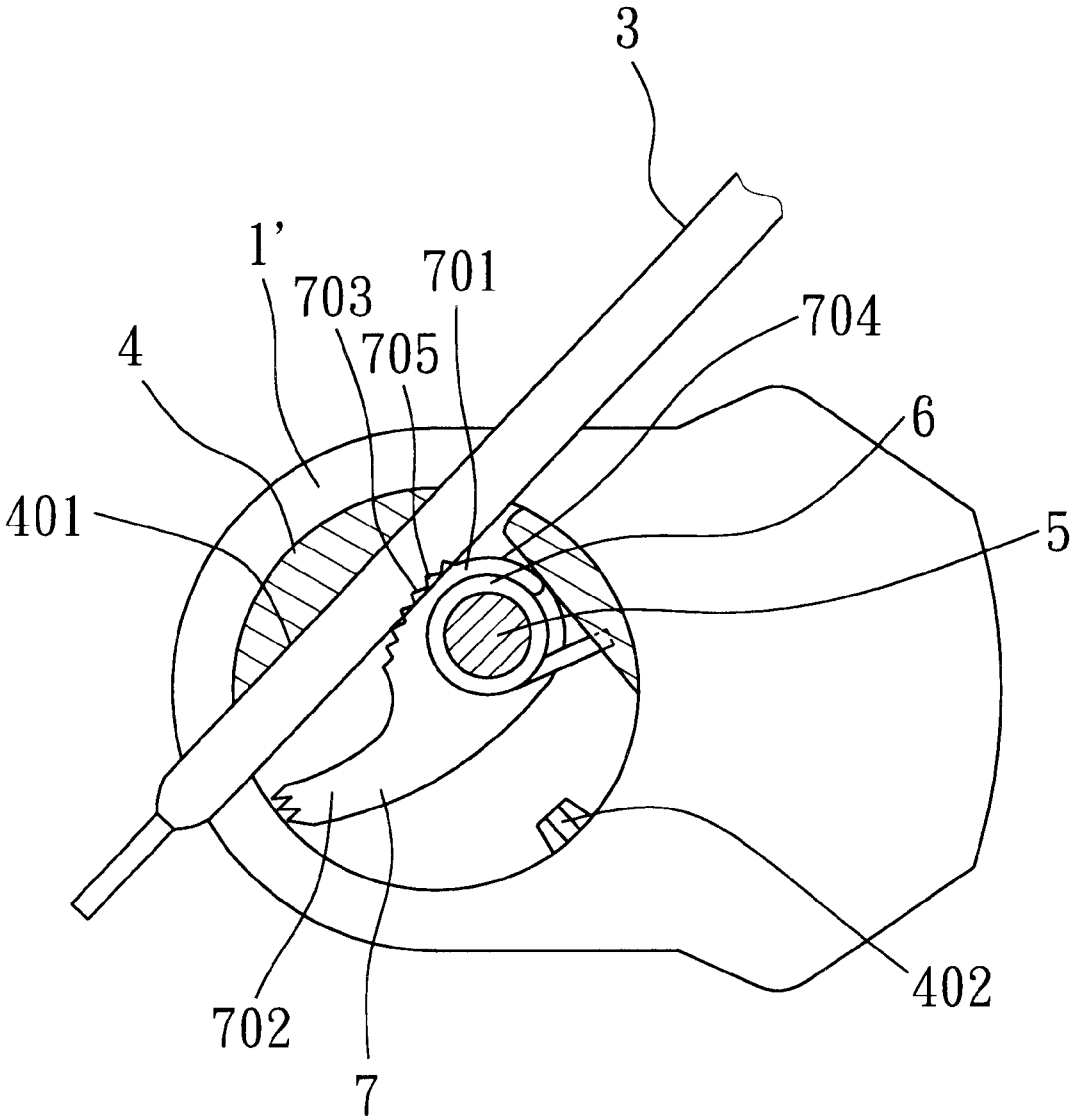
FIG. 2 PRIOR ART
FIG. 2 is a schematic view of the conventional lace tightening assembly in a lace tightening state.
Figure 3:
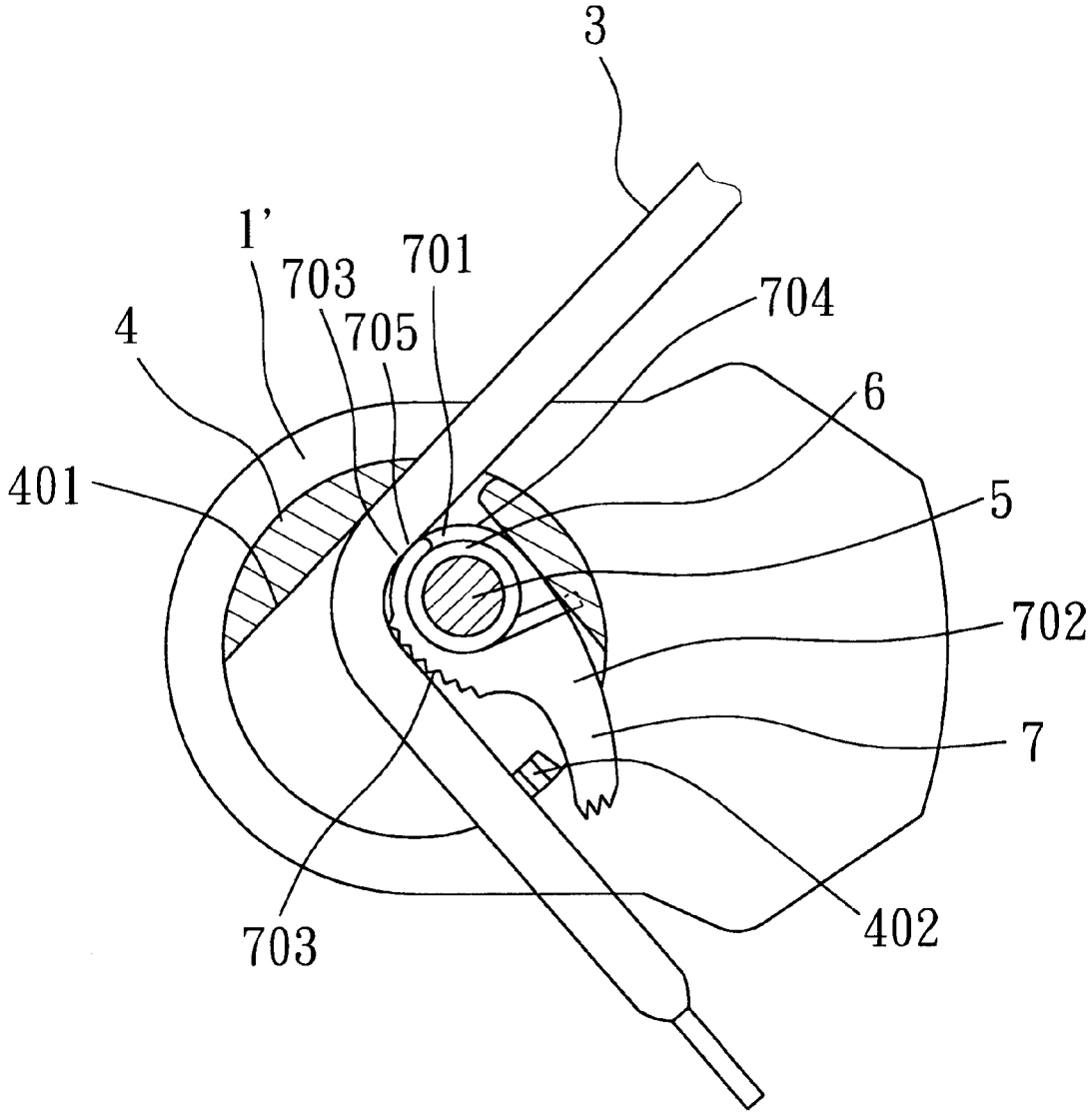
FIG. 3 PRIOR ART
FIG. 3 is a schematic view of the conventional lace tightening assembly in a lace loosening state.

2. The lace tightening assembly 1 has a relatively simple structure since it is not necessary to install the resilient member 6 as required in the prior art shown in FIG. 1, and is relatively easy to assemble.

3. Due to the absence of clamping teeth, the shoe lace 200 is not likely to be damaged by the lace tightening assembly 1.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lace tightening assembly adapted for use with a shoe body that has a front end, a rear end, a shoe opening adjacent to the rear end, a shoe tongue that extends along a reference line from the front end toward the shoe opening, a pair of eyelet tabs disposed on opposite lateral sides of the shoe tongue, and a shoe lace tied to the eyelet tabs, said lace tightening assembly comprising:

a mounting seat adapted to be mounted on one of the eyelet tabs adjacent to the shoe opening, said mounting seat including a base wall and a top wall vertically spaced apart from said base wall, each of said base and top walls having proximate and distal edges respectively disposed proximate to and distal from the shoe opening when said mounting seat is mounted on said one of the eyelet tabs, said mounting seat further including a side wall that interconnects said distal edges of said base and top walls and that cooperates with said base and top walls to form a lace receiving space, said side wall having an inner wall surface that confronts said lace receiving space and that has first and second wall ends opposite to each other and respectively disposed distal from and proximate to the shoe opening when said mounting seat is mounted on said one of the eyelet tabs, said side wall further having a cord hole formed therethrough for access to said lace receiving space;

a pivot axle extending between said base and top walls and disposed between said inner wall surface and the reference line when said mounting seat is mounted on said one of the eyelet tabs;

a tightening member disposed in said lace receiving space and having a pivot portion mounted pivotally on said pivot axle, a clamping portion extending from said pivot portion, and an actuating portion extending from said pivot portion and distal from said clamping portion, said tightening member cooperating with said inner wall surface of said side wall to confine a lace passage within said lace receiving space, said lace passage being adapted to permit passage of a segment of the shoe lace therethrough, and having a first passage opening defined by said first wall end and said actuating portion, and a second passage opening defined by said second wall end and said clamping portion; and an operating member including an operating portion disposed outwardly of said mounting seat, and a pull cord connected to said operating portion, said pull cord extending through said cord hole in said side wall and being connected to said actuating portion of said tightening member;

said tightening member being pivotable inside said lace receiving space between a shoe lace tightening position, in which said actuating portion is urged by the segment of the shoe lace to pivot toward the reference line to cause said clamping portion to move away from the reference line to thereby clamp the segment of the shoe lace at said second passage opening, and a shoe lace loosening position, in which said actuating portion is pulled to pivot away from the reference line upon application of a pulling force on said operating member to cause said clamping portion to move toward the reference line to thereby release the segment of the shoe lace from being clamped at said second passage opening.

2. The lace tightening assembly as claimed in claim 1, wherein said pivot axle forms a first radial distance with said first wall end, and further forms a second radial distance shorter than the first radial distance with said second wall end.

3. The lace tightening assembly as claimed in claim 2, wherein said actuating portion is provided with a limit rod that extends toward said inner wall surface of said side wall to limit extent of pivoting movement of said tightening member from said shoe lace tightening position to said shoe lace loosening position.

4. The lace tightening assembly as claimed in claim 3, wherein said pull cord is tied to said actuating portion at said limit rod.

5. The lace tightening assembly as claimed in claim 1, wherein said clamping portion is formed with a stop unit for engaging one of said base and top walls to limit extent of pivoting movement of said tightening member from said shoe lace loosening position to said shoe lace tightening position.

6. The lace tightening assembly as claimed in claim 1, wherein said mounting seat further includes a fixing ring connected to said base wall and adapted to be riveted onto said one of the eyelet tabs.

7. The lace tightening assembly as claimed in claim 6, wherein said fixing ring is formed with anti-slip claws adapted to engage said one of the eyelet tabs to resist rotation of said mounting seat on said one of the eyelet tabs.

* * * * *